United States Patent [19]

Edwards

[11] Patent Number: 4,501,501

[45] Date of Patent: Feb. 26, 1985

[54] PROCESS FOR DISPERSING SOLIDS IN LIQUID MEDIA

[75] Inventor: Harold W. Edwards, Springfield, Pa.

[73] Assignee: E. I. Du Pont de Nemours and Company, Wilmington, Del.

[21] Appl. No.: 598,185

[22] Filed: Apr. 9, 1984

Related U.S. Application Data

[63] Continuation-in-part of Ser. No. 472,102, Mar. 4, 1983 abandoned.

[51] Int. Cl.[3] ..... B01F 5/06

[52] U.S. Cl. ..... 366/336; 366/340; 138/42; 118/600; 118/612

[58] Field of Search ..... 118/600, 608, 612; 138/42; 210/266, 284, 290; 239/DIG. 18; 241/22; 366/336, 340, 348, 605

[56] References Cited

U.S. PATENT DOCUMENTS

| | | | |
|---|---|---|---|
| 2,581,414 | 1/1952 | Hochberg | 366/138 |
| 2,583,206 | 1/1952 | Borck et al. | 138/42 |
| 3,382,983 | 5/1968 | Stewart | 210/266 |
| 3,682,446 | 8/1972 | Eron | 366/336 |
| 4,121,906 | 10/1978 | Oldham | 366/336 |
| 4,204,775 | 5/1980 | Speer | 366/336 |

*Primary Examiner*—Robert W. Jenkins
*Assistant Examiner*—Arthur D. Dahlberg

[57] ABSTRACT

A process for the dispersion of particulate solids in liquid media by passing an admixture of the solids and liquid through a series of beds of substantially nondeformable spherical particles, each bed consisting of particles of substantially uniform size, the admixture being passed through at least one coarse bed of particles, at least one intermediate bed of particles and at least one fine bed of particles, with the flow rate of the liquid medium being adjusted to provide an increasing shear rate as the admixture passes through increasingly fine beds.

2 Claims, 2 Drawing Figures

PROCESS FOR DISPERSING SOLIDS IN LIQUID MEDIA

CROSS REFERENCE TO RELATED APPLICATION

This is a continuation-in-part of application Ser. No. 472,102, filed Mar. 4, 1983, abandoned.

BACKGROUND OF THE INVENTION

The manufacture of surface coatings involves the mixing of pigment in a suitable vehicle and dispersing the pigment to a satisfactory fineness, color, and consistency to form a mill base. The vehicle, as the term is used in the coatings industry, includes film-forming materials, resins, oils, thinners, dispersants, and driers, as well as mixtures of these components. The mill base, with pigment suitably dispersed, can then be incorporated into an appropriate coating formulation.

In preparing the mill base, the pigment is dispersed to a satisfactory fineness by breaking up all agglomerates of pigment particles and thoroughly wetting each particle with the liquid vehicle. This dispersion of pigment with the liquid vehicle has been achieved before by the use of various apparatus such as roller mills and media mills, including ball mills, pebble mills, and sand mills. Media mills are essentially high-shear mixers wherein rotation of the mill or of stirring elements relative to the mill in combination with the presence of media such as steel balls, pebbles, or sand imparts shearing action onto the pigment/vehicle mixture to accomplish dispersion. A process for dispersing pigment by agitating the pigment and vehicle in a suitable apparatus with 20–40 mesh sand is described in U.S. Pat. No. 2,581,414, issued Jan. 8, 1952 to Hochberg.

Media mills generally operate in a continuous fashion such as a continuous stirred tank reactor. In continuous operation, pigment/vehicle premix is added while simultaneously removing material that has been subjected to the shearing action of the mill. As with continuous stirred tank reactors, the distribution of dwell time under shear for proportions of particles can be broad and disparate, necessitating several passes of the pigment/vehicle premix through the media mill to insure adequate dispersion. A typical media mill unit may have a vessel size of perhaps 30 gals. When finishing a run, or changing to a different color mill base, it is necessary to clean out the vessel. This can result in as much as 12 gallons of material being washed out and thrown away.

SUMMARY OF THE INVENTION

The present invention relates to a process for achieving a thorough dispersion of pigment particles in a liquid vehicle to produce a pigment mill base for use in surface coatings formulations.

Specifically, the instant invention provides a process for the dispersion of particulate solids in liquid media comprising pumping a liquid premix containing an admixture of said solids and said liquid media through a plurality of orifices at a laminar flow velocity, there being sufficient pressure drop across said plurality of orifices to provide shear energy to cause said dispersion, the orifices being the network of tortuous paths formed from substantially nondeformable spherical particles arranged in a series of beds, each bed consisting of spherical particles of a substantially uniform size and comprising at least one coarse bed of particles having a diameter of at least about 0.5 mm, at least one intermediate bed of particles having a diameter of about from 0.5 to 0.15 mm, and at least one fine bed of particles having a diameter of about from 0.15 to 0.05 mm, and wherein the flow rate of the liquid medium is adjusted to provide a shear rate of about from 1500 to 6300 $sec^{-1}$ in each coarse bed, a shear rate of about from 3300 to 15,000 $sec^{-1}$ in each intermediate bed, and a shear rate of about from 10,000 to 3,000 $sec^{-1}$ in each fine bed.

BRIEF DESCRIPTION OF THE DRAWINGS

The Drawings illustrate a preferred apparatus in which to practice the invention.

DETAILED DESCRIPTION OF THE INVENTION

The present invention involves the deagglomeration and dispersion of particulate solids in liquid media by pumping a particulate solid/liquid premix through a plurality of orifices or capillaries at a laminar flow velocity where the resistance to premix flow results in a substantial pressure drop across the plurality of orifices or capillaries. Such pumping results in the development of both normal and extensional shear forces under laminar flow conditions, which separates pigment flocculates or agglomerates contained in the premix into dispersed pigment particles. The invention subjects pigment particles to a narrow distribution of dwell time under shear, which insures a predictable and similar shear history for each particle, thus eliminating the need for multiple passes to achieve adequate dispersion. The orifices or capillaries can be formed, for example, by packing a containing apparatus with non-deformable packing materials.

The present invention provides a process for achieving a thorough dispersion of particulate solids in liquid media. Polymer powders, including polyimide powders and fluorocarbon powders, can be dispersed in the manner of this invention. Of particular interest is the dispersion of pigment in a liquid vehicle to prepare mill bases for use in surface coating formulations.

The pigments of special interest to this invention are finely ground, natural or synthetic, organic or inorganic, insoluble solid particles which, when dispersed in a liquid vehicle to make a surface coating, provide many of the essential properties of that coating including color, opacity, durability, hardness, and corrosion resistance. Extender pigments, used for such properties as rheology control, durability, gloss control, or cost reduction are also within the scope of this invention. Of particular importance is achieving suitable dispersions of those pigments chosen for color and opacity properties, with a fundamental average particle size of 0.3 microns or less. Fundamental particle size refers to the particle size of the discrete pigment particles as opposed to the size of the agglomerated clusters comprising multiple pigment particles. Average particle size is determined by measurement of dried particles using an electron micrograph, and a weighted average calculated. Distribution of particle size is such that individual particles may be as much as 4–6 times the average size. With $TiO_2$, some particles may be as large as 3 microns.

Figure 1:
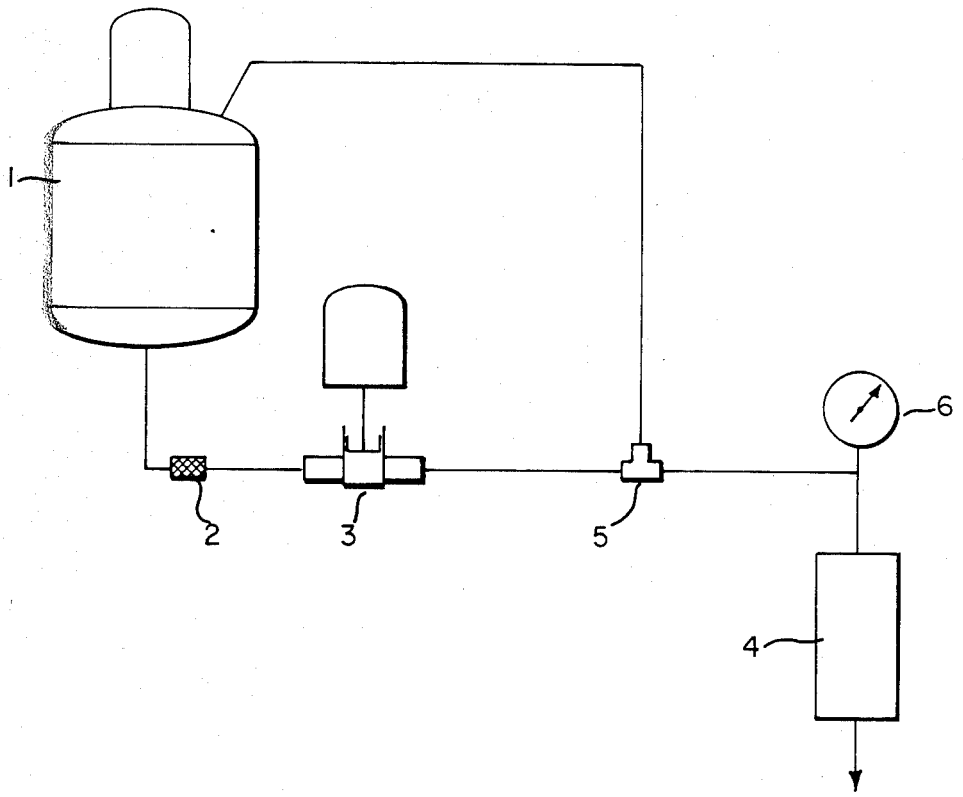
FIG. 1 is a schematic of a typical dispersion unit installation.

A preferred system for the dispersion process which is the subject of this invention is illustrated in FIG. 1. A pigment, resin, and solvent premix is prepared in an agitated premixer 1 and is fed through protective strainer 2 to high pressure feed pump 3. This pump can be of any type capable of providing an adequate quantity of premix at a minimum pressure of 3,000 psi. A typical installation uses a piston type metering pump capable of a maximum output of 90 GPH (gallons per hour) at pressures of up to 10,000 psi. Pumps with a higher pressure capability can also be used.

The pigmented premix is pumped at high pressure to the dispersion bed assembly 4 through a line equipped with a rupture disk 5 and a pressure pressure gauge or a transducer. If a pressure gauge is used, the pumping rate is normally controlled manually with visual reference to the gauge. If the pressure measurement is made by means of a transducer, automatic adjustment of the pumping rate is feasible.

Once the pigmented premix has passed through the dispersion bed assembly 4, the pressure is at or near atmospheric pressure and the dispersed mill base can be packaged directly into drums or storage mixers for subsequent use. The high pressure pumping capability required by the process results from the resistance to flow of the pigmented premix through the dispersion bed assembly 4. To achieve the highest possible shear rate, the system is operated at the highest pumping rate consistent with the pressure limitations of the overall system.

Figure 2:
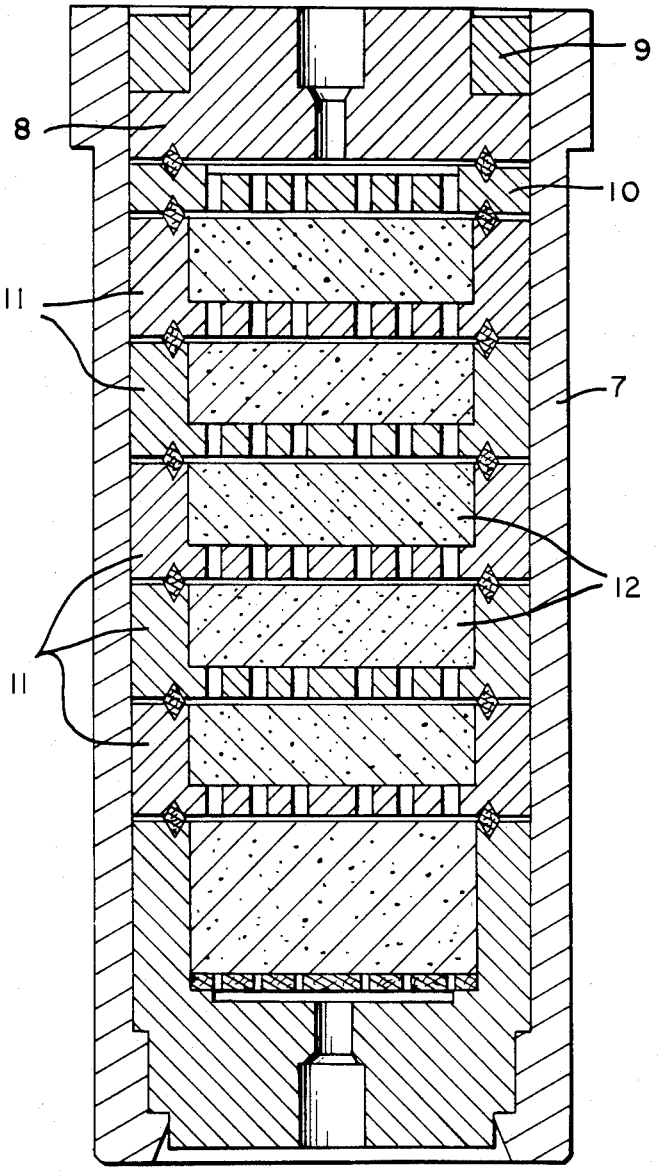
FIG. 2 is a sectional view of a preferred dispersion bed assembly.

A sectional view of a typical dispersion bed assembly 4 is shown in FIG. 2. The assembly is circular in cross-section and consists of a series individual bed holders 11 which can be stacked of inside the multi-bed retainer 7 and held in place by a holder top 8 and a retaining nut 9. The pigmented premix flows vertically from the top to the bottom of this assembly. Mounted at the top of the assembly is a distribution plate 10 which precedes the bed holders 11.

The bed holders 11 are filled with substantially non-deformable packing material 12 which provides a plurality of tortuous passages or capillaries through which the pigmented premix can pass. Dispersion takes place in passing the pigmented premix through these filled beds.

The bed packing material is selected from materials which do not substantially deform at the pressures involved in the dispersion process. Typically metallic, ceramic, glass, and rigid plastic materials can be used. The beds can be produced using a variety of substantially spherical particles. Particulate matter of various sizes can be mixed to produce these beds. However, uniformity is preferable in producing beds of uniform and predictable flow characteristics.

To achieve beds of uniform and predictable flow characteristics, spherical particles of a uniform size are a preferred filling material. Such beds of spherical particles are simple to produce, inexpensive, effective, and provide relatively uniform orifice sizes which can be controlled by selection of the sphere size. Spheres of a uniform size will fill a bed holder 11 in a substantially tetrahedral packing arrangement, though there may be some random packing or cubic packing due to any slight variations in sphere size. Finer size sphere beds tend to have more random packing than larger spheres.

Assuming spheres of uniform size in a tetrahedral packing arrangement, the size of the orifices produced can be defined in terms of an orifice diameter equivalent to the diameter of a smaller sphere that would fit among the interstices of the uniform spheres forming the tetrahedron. For example, uniform spheres of 0.5 mm diameter, with tetrahedral packing, would produce a bed having an average orifice diameter of 77 microns. Uniform spheres of 0.05 mm diameter would provide an average orifice diameter of 8 microns.

Selection of orifice size is an important aspect of this invention, in order to provide the necessary shear to break up all agglomerates of pigment and to thoroughly wet each particle of pigment with the vehicle. The smaller the orifice size the greater the shear imparted on the liquid premix for a given velocity of flow through the packed bed. The orifice size is selected on the basis of the particle size of the pigment being dispersed. Ideally, an orifice size only slightly larger than the pigment particle size would provide the greatest shear for a given velocity of flow. However, the pressure drop through such orifices would be high and plugging of the orifices can occur due to the presence of agglomerated clusters of pigment particles in the initial liquid premix. A reduction in the problem of plugging and a more practical pressure drop is obtained by selecting a larger orifice size, balanced against resulting less shear.

To minimize the problem of plugging, yet to achieve the fineness of dispersion necessary for a mill base, it is preferred to construct a series of sphere beds with progressively smaller orifice sizes. This can be readily accomplished by packing each of the bed holders 11 shown in FIG. 2 with different size spheres. The beds should be constructed so as to provide spherical particles of at least three degrees of coarseness. The largest spherical particles should be at least about 0.5 mm in diameter. The intermediate spherical particles should be about from 0.5 to 0.15 mm in diameter. The smallest particles should be about from 0.15 to 0.5 mm in diameter. At least one bed of spherical particles in each of these ranges should be provided.

Typically, the finest beds used are composed of 0.09 mm or 0.05 mm diameter spheres which produce orifice diameters of 14 microns and 8 microns, respectively. Finer spheres can be used but may not be practical because of the high pressure drop and low product throughput rate associated with these beds.

While the orifice diameters in beds composed of 0.09 mm or 0.05 mm spheres are one to three orders of magnitude larger than the individual pigment particles, the premix normally contains pigment clusters or agglomerates substantially larger than the orifices. Thus the potential exists for blocking or plugging the beds, particularly if the attractive forces between individual pigment particles in these pigment clusters are high. The plugging potential can be minimized by introducing coarser sphere beds into the premix flow stream prior to contacting the finest beds. Sizing these coarser sphere beds so that their orifices are large enough to allow the pigment clusters and agglomerates to break into smaller components will allow processing of the resultant materials through the finest beds.

Experience indicates that for a broad range of pigment particles, the coarsest bed in the series should normally be composed of 0.5 mm spheres although larger spheres have been used for coarser products. Intervening beds between the 0.5 mm bed and the 0.09 mm bed are required to minimize the problem of plugging. These beds should be sized so that the ratio of orifice cross-sectional areas between successive beds should not exceed 16 and preferably should be less than 3.2 for optimum results. A multiple assembly may consist of individual beds of 0.5 mm, 0.3 mm, 0.2 mm, 0.15 mm, 0.09 mm, and 0.05 mm diameter spheres having average orifice diameters (tetrahedral packing) of 77, 46, 31, 23, 14, and 8 microns, respectively. While the illustrated system combines these multiple beds into a system which allows a single pass by the pigment/vehicle premix, similar results can be obtained using single passes in sequence through each individual sphere bed in the series. While the illustrated system includes the series of individual bed holders 11 stacked inside multi-bed retainer 7, similar results can be obtained by preparing a single packed column prepared with spheres of decreasing particle size.

The paths of decreasing size resulting from the beds of spherical particles, combined with the rate of flow resulting from the pumping rate used for the system, results in increasing shear rates for the system. For a substantially random packing of the particles, in which 53.2% of the particles are packed in a tetrahedral configuration and 46.8% are packed in a cubic configuration, the rate of flow should be such as to provide a shear rate of about from 1500 to 6300 $sec^{-1}$ in the coarsest beds, about from 3300 to 15,000 $sec^{-1}$ in the intermediate beds, and about from 10,000 to 30,000 $sec^{-1}$ in the finest beds. The shear rate is the velocity through the orifices between the particles in the beds divided by the radius of the orifices. For purposes of the present invention, a random packing of the spherical particles is assumed. In such a random packing, the particles are arranged in both a tetrahedral and a cubic configuration, with 53.2% of the spheres in a tetrahedral configuration and 46.8% in a cubic configuration. Accordingly, 12.188% of the cross-sectional area of such a randomly packed bed is void, and, assuming a particle diameter of 1 mm, the size of a sphere that would fit among the interstices of the particles, assuming random packing, is 0.276 mm. Accordingly, the shear rate in sec−1 is calculated by the following formula:

$$\text{Shear Rate} = \frac{\left\{\dfrac{\text{Flow volume (cc/sec)}}{\text{Bed Area(cm}^2) \times 0.12188}\right\} \times 10}{\text{sphere diameter(mm)} \times 10\ 0.276}$$

In the discussion above, spherical media were chosen because of their availability, low cost, and the ability to construct uniform beds with predictable flow characteristics. Glass spheres are particularly suitable since they prevent contamination of the mill base with metal particles, a problem with the prior art media mills. It will be readily appreciated that the present invention offers clear advantages over prior art media mills. With a single pass through the illustrated embodiment, each particle of pigment in the premix is subjected to essentially equal amounts,of shear, unlike the broad dwell time distribution of the prior art media mills. Also, clean-up of the packed beds is readily accomplished with virtually no loss of material.

EXAMPLE 1

In a conventional agitated mixer, 13.34 parts of a styrene/methyl methacrylate/butyl acrylate/hydroxy ethyl acrylate resin at 75% weight solids, and 16.66 parts methyl amyl ketone were added and mixed for 15 minutes. To this vehicle system was added 70 parts of Rutile titanium dioxide pigment. This was mixed for 1 hour.

The resultant pigmented premix was pumped in a single pass through a multiple bed dispersion unit, using a high pressure dual piston pump, at a rate sufficient to give a pressure drop of 9000 psi across the multiple bed unit. The multiple bed unit had four beds, each composed of a different size of uniform glass spheres. The first bed was composed of 0.5 mm diameter spheres 0.5 inches deep, the second bed of 0.3 mm spheres 1.75 inches deep, the third bed of 0.2 mm diameter spheres 1.0 inches deep, and the fourth bed of 0.15 diameter spheres 0.5 inches deep. The total sphere bed depth was 3.75 inches.

The pumping rate used produced a shear rate of 5400 $sec^{-1}$ in the 0.5 mm sphere bed, 9000 $sec^{-1}$ in the 0.3 mm sphere bed, 13,500 $sec^{-1}$ in the 0.2 mm sphere bed, and 18,000 $sec^{-1}$ in the 0.15 mm bed. Calculations indicate that the maximum Reynold's Number achieved in the 0.15 mm sphere bed was 0.88, which is well within the laminar area of fluid flows.

The resultant dispersion was superior to dispersions made via conventional media mills in color, in freedom from grit, and at least equal in tinting strength. The resultant dispersion was particularly suitable for use in high solids acrylic enamels for automotive or industrial use.

EXAMPLE II

In a mixer equpped with a high speed disperser, 45.00 parts of an acrylic copolymer (59% weight solids in xylene), 11.50 parts xylene, 2.50 parts VM&P Naptha were added and mixed for 5 minutes. To this vehicle system was added 9.00 parts Monastral ® Red pigment, then mixed for 30 minutes. An additional 19.00 parts of the acrylic copolymer (59% weight solids in xylene), 8.36 parts xylene, and 4.64 parts VM&P Naptha were added, then mixed for 10 minutes.

The resultant pigmented premix was pumped through a multiple bed dispersion unit, using a high pressure dual piston pump, at a rate sufficient to produce a 9000 psi pressure drop across the multiple bed unit. The multiple bed unit had five beds, each using uniform glass spheres of a different size. The first bed was packed with 0.5 mm diameter spheres 0.5 inches deep, the second bed with 0.3 mm diameter spheres 1.25 inches deep, the third bed with 0.20 mm diameter spheres 1.0 inches deep, the fourth bed with 0.15 mm diameter spheres 0.5 inches deep, and the fifth bed with 0.09 mm diameter spheres 0.5 inches deep.

The pumping rate used produced a shear rate of 3900 $sec^{-1}$ in the 0.5 mm sphere bed, 6600 $sec^{-1}$ in the 0.3 mm sphere bed, 9800 $sec^{-1}$ in the 0.2 mm bed, 13,000 sec-$^{-1}$ in the 0.15 mm sphere bed, and 22,000 $sec^{-1}$ in the 0.09 mm sphere bed. A maximum Reynold's Number of 0.18 was obtained in the 0.09 mm sphere bed, well within the laminar area of fluid flow.

The resultant pigmented mill base was equal in tinting strength and color to that produced by conventional media mills.

EXAMPLE III

In a conventional agitated mixer, 6200 parts fatty acid alkyd resin (80% solids), 26.77 parts ethylene glycol monoethyl ether, and 1.33 parts ethylene glycol monoethyl ether acetate were added and mixed for 15 minutes. Resinated phthalocyanine blue pigment, 9.90 parts, was added slowly with agitation and mixed for 1 hour.

The resultant pigmented premix was pumped in a single pass through a multiple bed dispersion unit, using a high pressure dual piston pump, at a rate sufficient to give a pressure drop of 8,300 psi across the multiple bed unit. The multiple bed unit had six beds, each bed composed of a different size of uniform glass spheres. The first bed was composed of 0.5 mm diameter spheres 0.5 inches deep, the second bed of 0.3 mm spheres 1.25 inches deep, the third bed of 0.2 mm spheres 0.5 inches deep, the fourth bed of 0.15 mm spheres 0.5 inches deep, the fifth bed of 0.09 mm spheres 0.5 inches deep, the sixth bed of 0.05 mm spheres 0.5 inches deep.

The pumping rate used resulted in shear rates of 1500 $sec^{-1}$, 4600 $sec^{-1}$, 6900 $sec^{-1}$ 9300 $sec^{-1}$, 15,000 $sec^{-1}$, and 26,000 $sec^{-1}$ in the respective beds. Maximum Reynolds Number obtained in the 0.05 mm sphere bed was 0.07, well within laminar flow area.

The dispersion produced was superior in color, tinting strength, transparency, and two-tone color characteristics to similar dispersions made in conventional media mills.

I claim:

1. A process for the dispersion of particulate solids in liquid media comprising pumping a liquid premix containing an admixture of said solids and said liquid media through a plurality of orifices at a laminar flow velocity, there being sufficient pressure drop across said plurality of orifices to provide shear energy to cause said dispersion, the orifices being the network of tortuous paths formed from substantially nondeformable spherical particles arranged in a series of beds, each bed consisting of substantially spherical particles of a substantially uniform size in comprising at least one coarse bed of particles having a diameter of at least about 0.5 mm, at least one intermediate bed of particles having a diameter of about from 0.5 to 0.15 mm, and at least one fine bed of particles having a diameter of about from 0.15 to 0.05 mm, and wherein the flow rate of the liquid medium is adjusted to provide a shear rate, as measured assuming random packing of the spherical particles, of about from 1500 to 6300 $sec^{-1}$ in each coarse bed, a shear rate of about from 3300 to 15,000 $sec^{-1}$ in each intermediate bed, and a shear rate of about from 10,000 to 30,000 $sec^{-}$ in each fine bed.

2. A process of claim 1 wherein the pressure drop across the series of beds is at least about 3000 psi.

* * * * *